US006871364B1

(12) United States Patent
Leoutsakos

(10) Patent No.: US 6,871,364 B1
(45) Date of Patent: Mar. 29, 2005

(54) FOOT LIFT

(76) Inventor: Thomas Leoutsakos, P.O. Box 922, Randolph, MA (US) 02368

( * ) Notice: Subject to any disclaimer, the term of this patent is extended or adjusted under 35 U.S.C. 154(b) by 199 days.

(21) Appl. No.: 09/556,157

(22) Filed: Apr. 21, 2000

(51) Int. Cl.[7] ..... A61G 7/10; B66F 3/24

(52) U.S. Cl. ..... 5/83.1; 5/81.1 R; 5/658; 254/93 HP

(58) Field of Search ..... 5/658, 662, 81.1 R, 5/83.1, 503.1, 507.1, 646, 648, 86.1; 414/921; 254/93 HP; 297/DIG. 10

(56) References Cited

U.S. PATENT DOCUMENTS 2,587,068 A * 2/1952 Sanders ..... 5/86.1
2,609,862 A * 9/1952 Pratt ..... 5/86.1 X
3,376,070 A * 4/1968 Johnson ..... 297/452.26
3,786,523 A * 1/1974 Sele ..... 5/87.1
3,967,328 A * 7/1976 Cox ..... 5/81.1 C
4,602,773 A * 7/1986 Craven, Jr. ..... 5/646
4,688,760 A * 8/1987 Garman et al. ..... 254/93 HP
4,700,415 A * 10/1987 DiMatteo et al. ..... 5/88.1
4,786,032 A * 11/1988 Garman et al. ..... 254/93 HP
4,837,873 A * 6/1989 DiMatteo et al. ..... 5/81.1 C
4,993,736 A * 2/1991 Garman et al. ..... 280/304.1
4,997,200 A * 3/1991 Earls ..... 280/648
5,170,522 A * 12/1992 Walker ..... 5/615
5,361,433 A * 11/1994 Vanzant ..... 5/81.1 R
5,375,910 A * 12/1994 Murphy ..... 297/256.13
5,408,710 A * 4/1995 Garman et al. ..... 5/83.1
5,438,722 A * 8/1995 Jayamanne ..... 5/618
5,461,736 A * 10/1995 Carpenter et al. ..... 5/662 X
5,505,518 A * 4/1996 Pike ..... 5/83.1 X
5,584,082 A * 12/1996 Crawford et al. ..... 5/86.1
5,651,149 A * 7/1997 Garman ..... 5/81.1 R
5,669,086 A * 9/1997 Garman ..... 5/86.1
5,699,569 A * 12/1997 Schwarz-Zohrer ..... 5/655
5,742,957 A * 4/1998 Vanzant ..... 5/81.1 R
5,806,110 A * 9/1998 Kunz et al. ..... 4/566.1
5,896,602 A * 4/1999 Marblestone ..... 5/81.1 R
5,918,936 A * 7/1999 Murphy ..... 297/313
5,934,414 A * 8/1999 Staczek ..... 254/93 HP X
5,966,762 A * 10/1999 Wu ..... 5/710
5,970,545 A * 10/1999 Garman et al. ..... 5/615
6,003,949 A * 12/1999 Rinne et al. ..... 297/452.21
6,113,188 A * 9/2000 Stewart et al. ..... 297/339
6,199,827 B1 * 3/2001 Rimington et al. ..... 254/93 HP
6,286,812 B1 * 9/2001 Cherry ..... 254/93 HP X
6,317,909 B1 * 11/2001 Blum ..... 5/654
2003/0154550 A1 * 8/2003 Murphy et al. ..... 5/648

FOREIGN PATENT DOCUMENTS

WO WO 088007848 A * 10/1988 ..... 5/83.1

* cited by examiner

*Primary Examiner*—Robert G. Santos
(74) *Attorney, Agent, or Firm*—G. Kersey

(57) ABSTRACT

Support method and apparatus for providing a secure and stable method for a user/patient to transfer a body part, such as a foot, into and out of a bed independently, and thus enhance in-bed mobility. The support for the body part is by a rest member having an associated expandable member. The rest member is a platform configured to the body part being supported, and the expandable member is a bellows adhered to the platform and expandable by a compressor. In the method a body part is positioned on the rest member, which is expanded with the body part thereon.

28 Claims, 7 Drawing Sheets

Fib. 4E
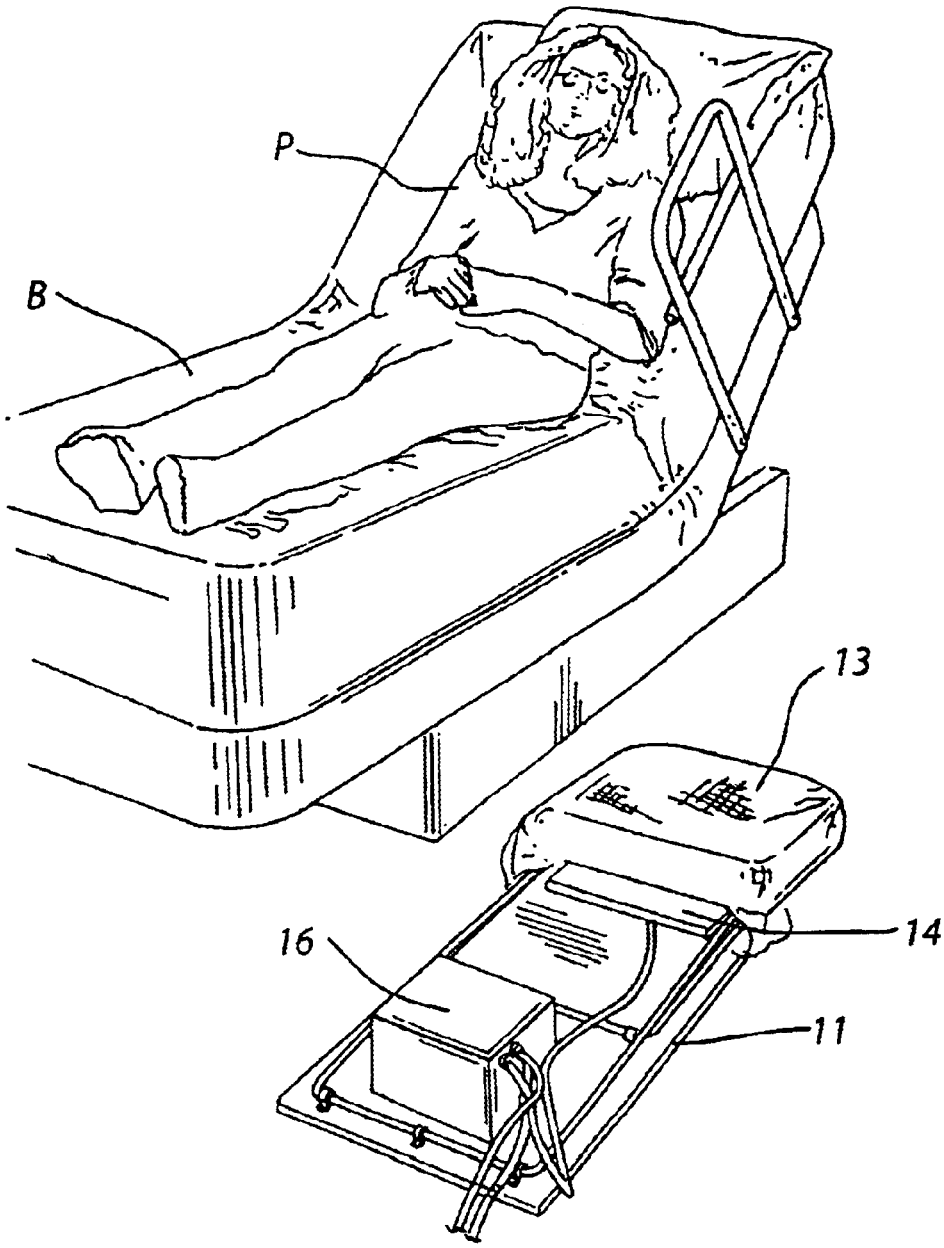

FOOT LIFT

BACKGROUND OF THE INVENTION

1. Field of the Invention

This invention relates to support and, more particularly, to support apparatus for assisting a user in transferring a body part into and out of bed, as well as facilitating in-bed mobility.

2. Description of the Prior Art

A transfer into and out of bed, as well as maneuvering in bed, may be difficult for many persons, such as those who are elderly or disabled.

Typical beds provide little or no added support to assist persons in gaining balance while transferring into or out of a bed, or helping adjust in-bed posture. Particularly at risk of falling or having difficulty, are acute or chronic term patients, particularly in a home environment, where assistance is required for maneuvering into and about a bed. Such patients generally require a secure and stable method to transfer into and out of a bed independently. A wheelchair user, for example, may find it particularly difficult to transfer into and out of bed without assistance.

While various home care and hospital beds have been available, these beds are generally expensive. A patient may require only temporary support and not require a special bed so that it would be advantageous if existing arrangements can be modified.

It is therefore an object of the invention to provide apparatus which achieves a secure and stable method for transfer of body parts. A related object is to achieve a secure and stable method for transfer into and out of bed independently, and improve in-bed mobility.

A further object of the invention is to provide support which can be easily placed into and out of service, as well as be quickly used in association with, for example, a bed.

SUMMARY OF THE INVENTION

In accomplishing the foregoing and related objects, the invention provides for supporting a body part by an expandable rest or support member with the body part thereon.

In accordance with one aspect of the invention the body part support can be associated with an auxiliary surface, such as that provided by a bed or chair. The body part can be a foot, arm or any other part that needs to be elevated.

The rest or support member desirably is a platform that is configured to the body part that is being supported, for example having a surface depression conforming to the part being elevated, and is elevated by a compressor-operated bellows or related device, such as a scissors mechanism, adhered to the platform. The expansion can take place by inflating the expandable member having a safety guard therefor.

In a method of the invention for supporting a body part; the steps include (a) positioning the body part on a rest surface; (b) elevating the rest surface with the body part supported thereon and (c) transferring the body part from the rest surface.

A further step is to move the rest member rearwardly as it is being elevated by expansion.

The method further includes expanding the rest surface in association with a recliner and the positioning step includes positioning a foot, arm or other body part on the rest surface. The method also includes the step of expanding the rest member by a compressor.

In a method of the in for fabricating a support for a body part the steps include (a) roving a platform configured to the body part; and (b) attaching an expandable member to the platform.

The method of fabrication further includes the step attaching a bellows to the platform to serve as the expandable member, and inflating the bellows through a valve for attaching a compressor.

The method also including the steps of providing for inflating the bellows; providing a valve by which the expandable member can be inflated; and providing for attaching a compressor to the valve.

A system of the invention for assisting persons into adopting a reclined position from a sitting position, comprises providing a receiving surface upon which a person is to recline; and transferring the person to the receiving surface by elevating a lower limb of the person to a level permitting the transfer of the person to the receiving surface with the lower limb in a reclined position.

The receiving surface can be a bed which includes a mattress and the transferring mechanism can be positioned on a platform and further include a support for the lower limb; provision for elevating the support with respect to the platform to permit the transfer of the lower limb to the surface.

The support can be depressible to the vicinity of the platform after the lower limb has been transferred, and the elevating mechanism can be switch-actuatable, selected from the class of manually and automatically powered devices.

A method of the invention for assisting persons into adopting a reclined position on an elevated surface includes the steps of (a) positioning a person's lower limb on a member for elevating the lower limb; (b) elevating the lower limb; and (c) transferring the lower limb to the elevated surface from the elevating mechanism for the lower limb adjoining the elevated surface.

In one aspect of the method a person is wheeled to the mechanism for elevating the lower limb and the foot portion of the lower limb is positioned on the elevating mechanism.

The lower limb is elevated to substantially the level of the elevated surface to which transfer is to take place, such that the person can adopt a reclined position.

BRIEF DESCRIPTION OF THE DRAWINGS

Other objects and features of the present invention will become apparent from the following detailed description, taken in connection with the accompanying drawings which disclose preferred embodiments of the invention, illustrative and not limiting of the invention:

FIG. 4E shows the patient with both legs transferred from the foot lift to the bed, followed by collapse of the foot lift to its original equilibrium position;

DETAILED DESCRIPTION OF THE PREFERRED EMBODIMENTS

Figure 1:
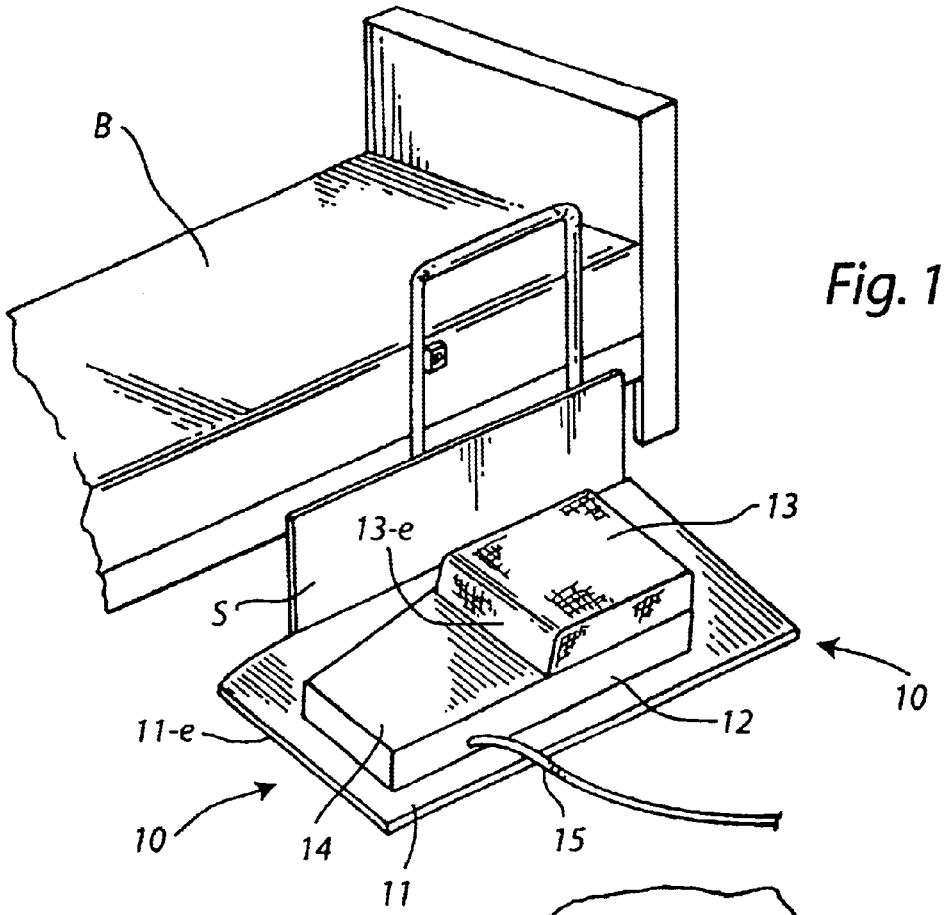
FIG. 1 is a perspective view of one embodiment of the present invention having a rest member for a body part and an associated expandable member, in position at the side of an associated support surface taking the form of a bed.

With reference to the Figures, wherein like numerals indicate like elements, FIG. 1 illustrates an embodiment of a lift 10 of the present invention; easily used in conjunction with a typical bed B.

The lift 10 is formed by a base 11 upon which is mounted an expandable bellows 12 that acts upon a rest surface 13. A protective shield S can be associated with the lift 10 to prevent a foot, or other body part, from being caught between the bed B and the lift 10 during operation.

The rearward portion of the lift 10 has a cover 14 that extends from a rear edge 11-*e* of the base 11 to the rear edge 13-*e* of the foot rest 13 mer ly to serve as an enclosure for an underlying expandable bellows 12.

In order to provide for expansion of the bellows 12, the lift 10 has an attached electrical cord 15 that is connected to a pump 16. The cord 15 is plugged into any convenient electrical outlet and can include an operating switch (not shown).

Although the embodiment of FIG. 1 is provided with a line cord 15 for connection to an outlet, it will be appreciated that a rechargeable battery installation may be used instead in order to avoid the presence of cords which could pose a hazard to infirm patients.

Figure 2:
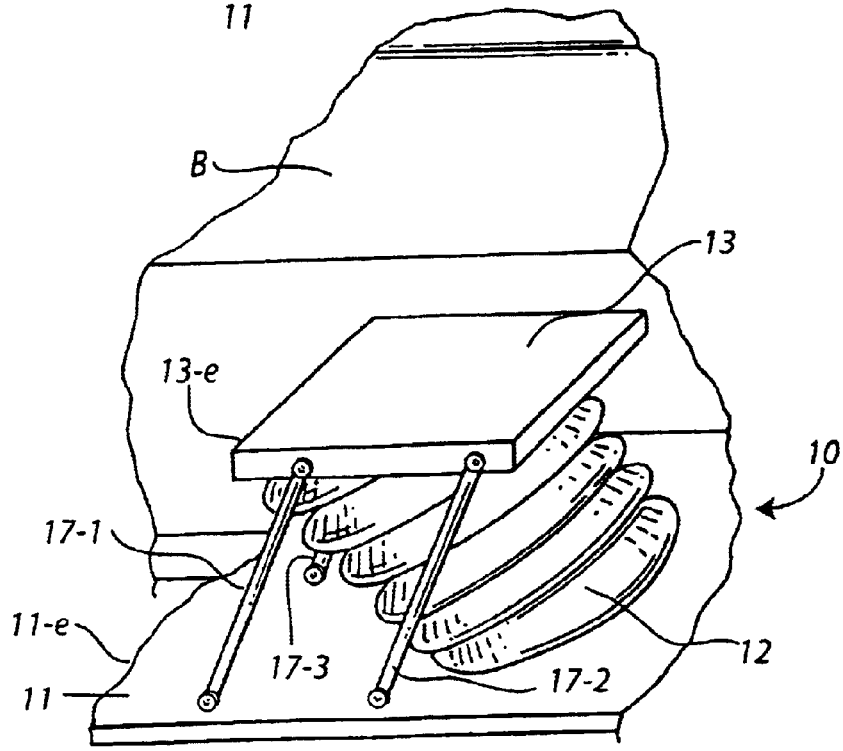
FIG. 2 is a perspective view of the invention after bellows expansion of the expandable member to bring the rest member to the level of the associated support surface.
Figure 3:
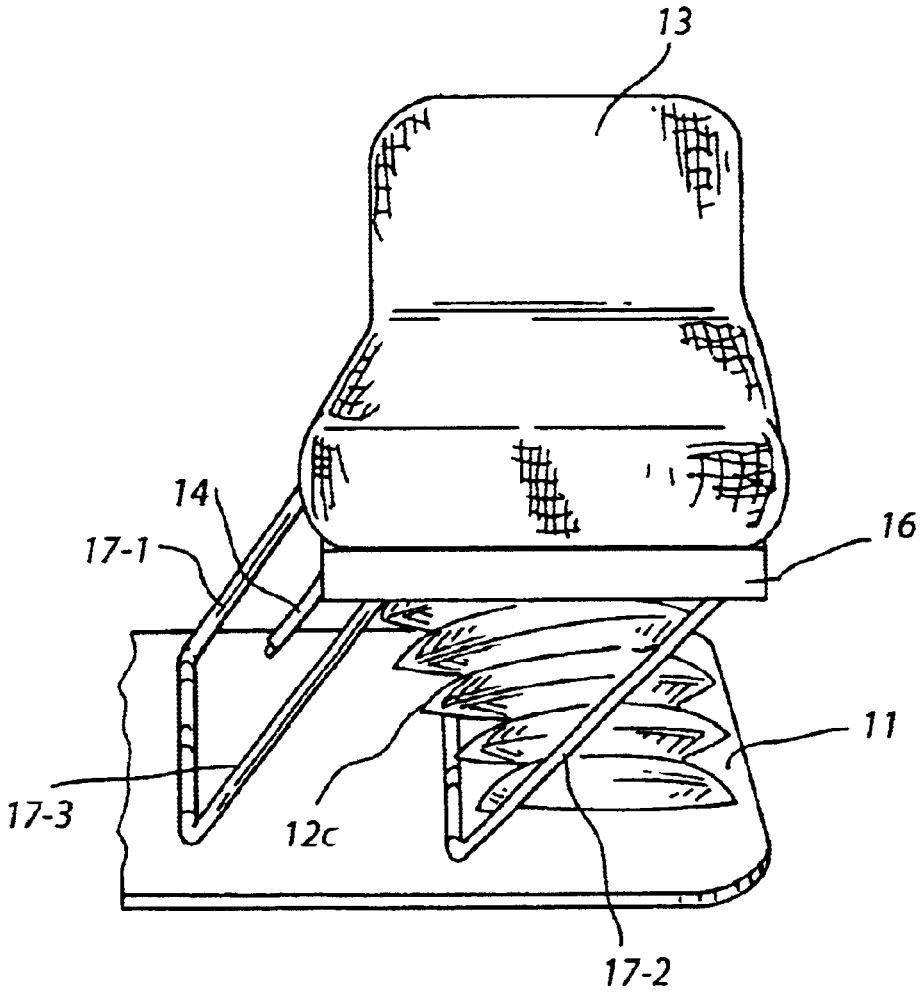
FIG. 3 is a further view of the foot lift device of FIG. 2 showing an illustrative expanded bellows.

When the lift 10 is energized, the result is as indicated in FIG. 2 where the rest surface 13 has been elevated by being moved upwardly and rearwardly so that the cover 14 is moved from its relatively horizontal position in FIG. 1 to an inclined elevation as shown in FIG. 3.

Details of the bellows 12 are shown in FIG. 3 where the cover 14 has been elevated to show the bellows expanded by operation of the pump 16 with the rest 13 elevated by by connection to pivoted support rods 17, of which only the rods 17-1 through 17-3 are visible in FIG. 3.

The bellows 12 is formed with corrugations 12-C so that when the pressure is released, the bellows collapses with thee-corrugations in contact with one another in standard fashion.

It will be appreciated that although the expandable member of FIGS. 1–3 is a bellows, other mechanisms may also be employed, including for example, a scissors device in which a lead screw is rotated to bring pivoted arms together to raise an upper plate with respect to a lower plate and thus provide a motion which is equivalent to that of the bellows in FIGS. 1–3.

In any case, whether the expandable member is a bellows or a scissors device, it may be actuated either manually or automatically and, in the case of a bellows, a quick release may be included so that the apparatus 10 may be returned quickly to its original state as shown in FIG. 1, after the desired elevation of the foot or other body part has taken place.

In an illustrative employment of the invention shown in FIGS. 4A through 4E foot lift service is provided for a person P in a wheelchair 40. The chair 40 is moved over the apparatus 10, which is at the side of the bed B, and the occupant of the chair is moved or is positioned in relation to the bed B with a foot or feet on the rest 13.

Figure 4A:
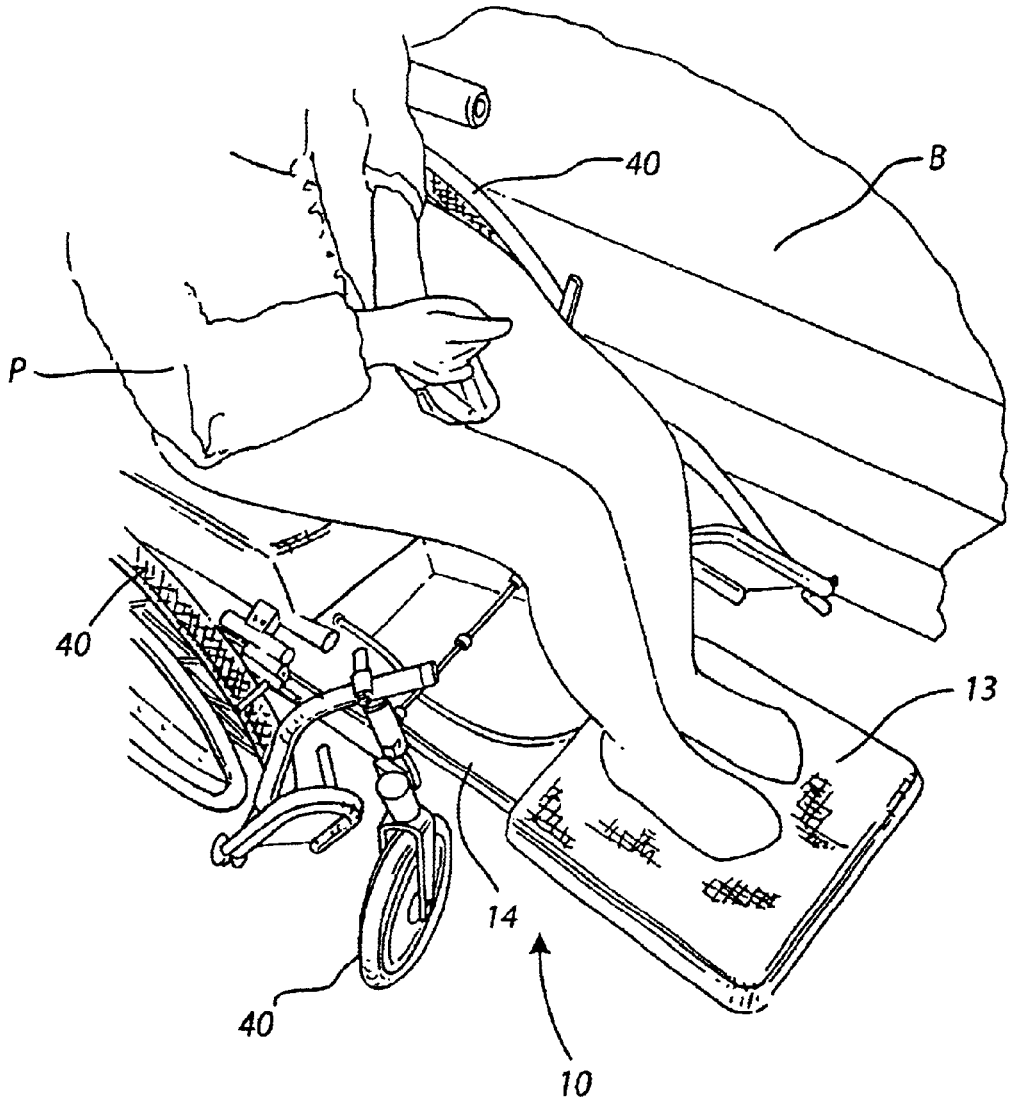
FIG. 4A illustrates the use of the invention by a wheel chair patient who has positioned the chair above the foot lift of the invention preparatory to elevating the foot near a bed.
Figure 4B:
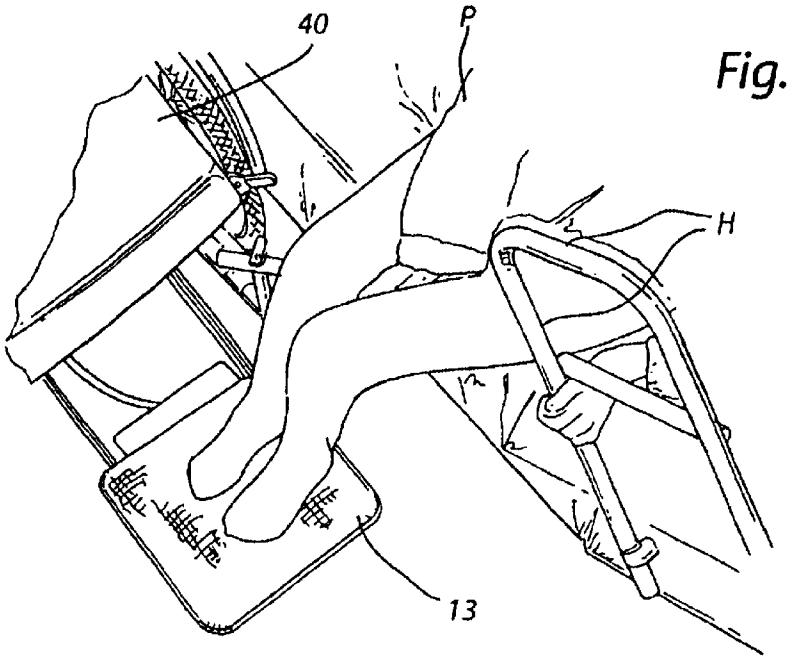
FIG. 4B shows the patient of FIG. 4A positioned on a bed after body movement from the wheel chair to the bed, making use, if necessary, of a bed rail.
Figure 4C:
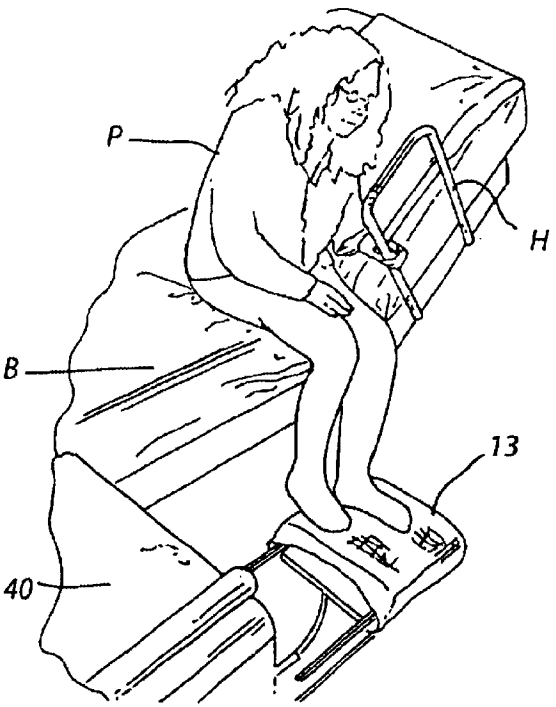
FIG. 4C is an alternative view showing the position of the patient upon the bed in FIG. 4B.

After the wheelchair 40 is suitably positioned, the body of the person P moves, or is moved, to the bed B as indicated in FIG. 4B, making use, if necessary, of a bed handle H, as illustrated in FIG. 4C.

Figure 4D:
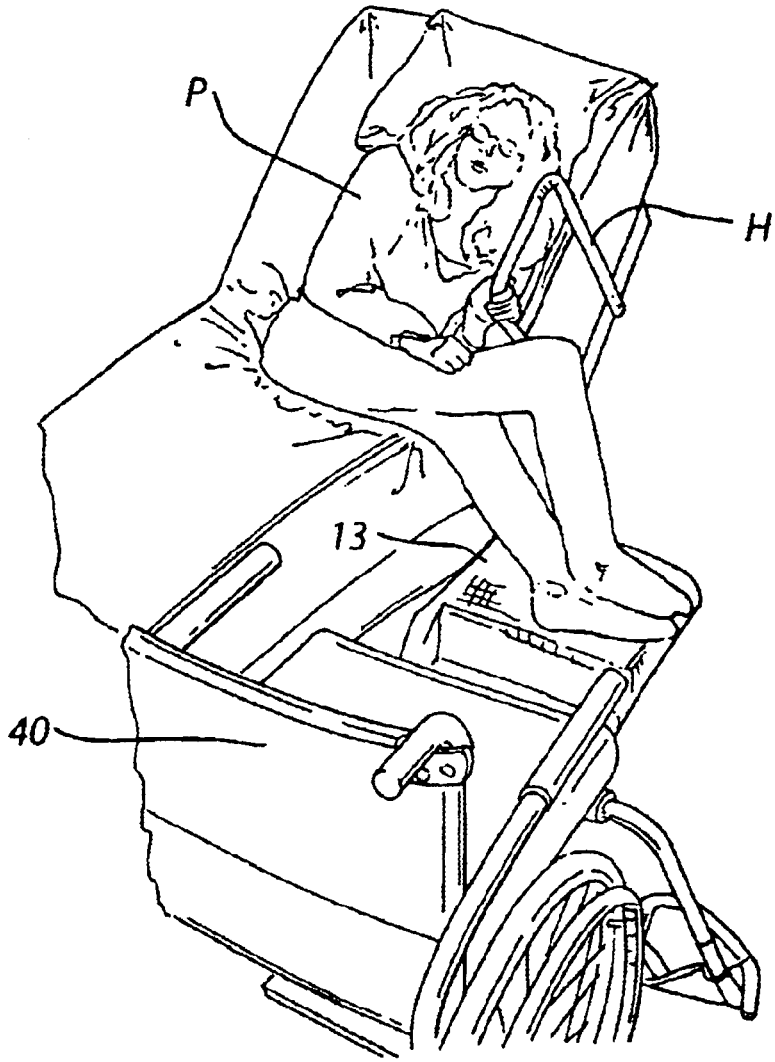
FIG. 4D shows the foot lift after operation to elevate the legs of the patient to the level of the bed.

In the next step illustrated in FIG. 4D, the pump 16 of the bellows (not visible in FIG. 4A or 4C) under the cover 14 is then operated to elevate the rest 13 to the level of the bed B so that the the foot or feet of the occupant P occupant of the chair 40 can easily move from the rest 13 to the bed B.

After both legs and feet of the patient P have been transferred from the foot lift 23 to the bed B as shown in FIG. 4E, the foot lift 13 is collapsed to its original equilibrium position, and the apparatus 10 can be moved away an conveniently towed.

Figure 5A:
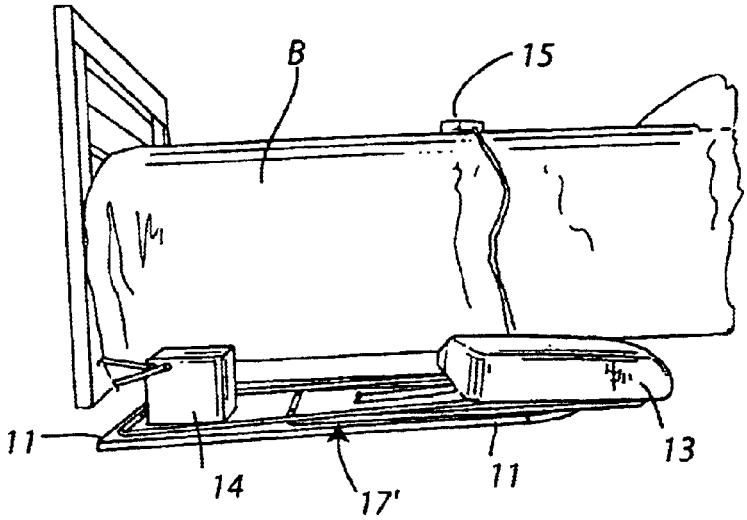
FIG. 5A is a side view of a further foot lift of the invention in its original equilibrium position with the lift member retracted against its supporting platform.
Figure 5B:
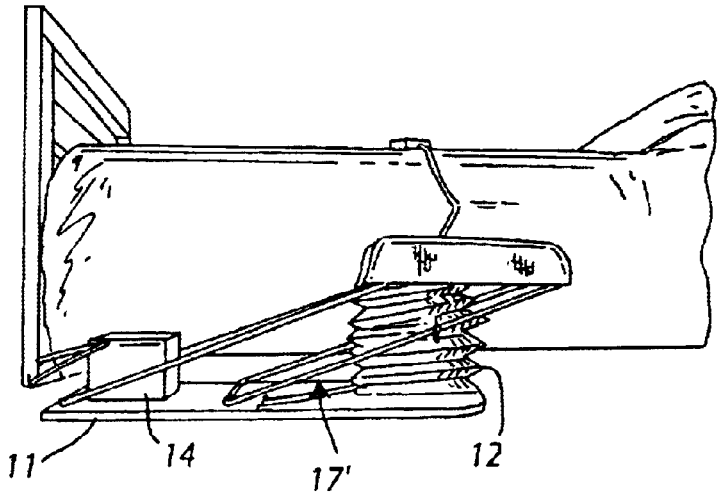
FIG. 5B is a side view of the further foot lift in its half elevation position with the lift member retracted against the supporting platform.
Figure 5C:
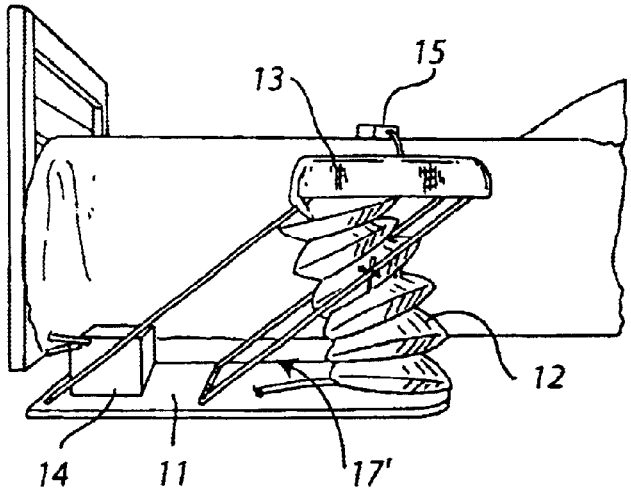
FIG. 5C is a side view of the further foot lift in its full elevation position with the lift member retracted against the supporting platform.

Further structural details for the foot lift 10 are shown in FIGS. 5A through 5C.

FIG. 5A is a side view of the foot lift of the invention in its original equilibrium position with the lift member 13 retracted against its supporting platform 11.

In the side view of FIG. 5B, the foot lift is in-its half elevation position with the bellows 12 partially expanded.

In FIG. 5C the foot lift is in its full elevation position with the bellows 12 fully expanded away from the supporting platform 11.

In FIGS. 5A through 5C the tubular member 17-1' through 17-4' have pivots farther away from the rest 13, as compared with FIGS. 1 through 3.

The base 11 is typically made from a lightweight, rigid material such as plastic, fiberglass, wood or metal. Preferably, the base 11 is constructed of a plastic such as high density polyethylene or polyvinylchloride, or a composite wood material, such as standard plywood, which has the advantage of light weight, strength and low cost.

Alternatively, the base plate 11 can be from a metal, such as stainless steel or aluminum, for strength and durability. The plate 11 typically is shaped to accommodate the elevating mechanism 13.

In general, the plate 11 may be any shape that supports members for hinging the rest member 13. Furthermore, the plate 11 should be relatively long and thin. In addition to the tubular members 17 and 17', the plate 11 provides additional stability for the apparatus 10.

The tubular members 17 and 17' typically are from a rigid, durable material such as a hard plastic or metal, preferably from steel pipe or aluminum pipe for reduced weight. The tubular members 17 and 17' have a central aperture, or bore, with a tubular axis. The internal diameter or bore, is wide enough to provide support and narrow enough to be inconspicuous. Typically, the diameters are about ⅛ to ¼ inch.

The tubular members 17 and 17' can be secured to support braces prior to being attached to the plate 11. The members 17 may be secured to support braces in any manner known to those skilled in the art, including being screw-fit, snap-fit, or welded to support braces.

Support braces typically includes holes which align with mating holes to allow bolts, pins, clips, or any other suitable means (not shown) for attachment. In this manner, the braces, including the tubular members, may be removably attached. Alternatively, any braces and the tubular members may be fixed (for example, welded). Another approach involves braces and tubular members that are independently and removably attached to plate member 11.

While the illustration of the invention in FIGS. 4A through 4E are for a wheelchair patient that has maneuvered the chair into position over the foot lift of the invention by having the wheels of the chair straddle the rear portion of the foot lift, to permit the legs of the patient to be positioned upon the rest member preparatory to elevating the foot of the patient near a bed, the invention can be used in any environment where the assisted elevation of a body part is desired.

Although preferred embodiments of the present invention have been disclosed for illustration, those skilled in the art will appreciate that various modifications, additions and substitutions are possible, without departing from the scope and spirit of the invention as set forth in the accompanying claims.

What is claimed is:

1. A system for assisting a person to have a lower limb adopt a reclined position from a sitting position, comprising a surface upon which said person is to be seated; and means for elevating said lower limb of said person to a level permitting the transfer of said lower limb to a reclined position on said surface;

wherein the means for transferring is positioned on a floor-based platform, further including a support for said lower limb and means for continuously elevating said support with respect to said platform by elevating said support and permit the transfer of said lower limb to said surface, with said support being depressible in level condition to the vicinity of said platform after said lower limb has been transferred.

2. Apparatus as defined in claim 1 wherein said body part is a foot positioned on said rest member in the non-expanded position of said expandable member.

3. Apparatus as defined in claim 1 wherein said rest member is a platform that is supported by a tubular member.

4. Apparatus as defined in claim 3 wherein said platform is configured to said body part when said rest member is in the non-expanded position of said expandable member.

5. Apparatus as defined in claim 1 wherein said expandable member is selected from the class consisting of externally reinforced bellows and scissors mechanisms.

6. Apparatus as defined in claim 5 wherein said expandable member is adhered to a portion of said platform.

7. Apparatus as defined in claim 1 wherein said means for expanding includes means for inflating said expandable member and further including a safety guard therefor.

8. Apparatus as defined in claim 7 wherein said means for inflating comprises a compressor.

9. A system as defined in claim 1 wherein said surface comprises a bed.

10. System as defined in claim 9 wherein said bed includes a mattress.

11. A system as defined in claim 1 wherein said elevating means is switch-actuatable.

12. A system as defined in claim 11 wherein said elevating means is selected from the class of manually and automatically powered devices.

13. Apparatus for supporting a body part, comprising: a rest member for said body part;

an expandable member associated with said rest member; and means for expanding said expandable member upwardly and forwardly at an angle with respect to a base of said expandable member, with said body part on said rest member; further including an auxiliary surface associated therewith and said body part is an arm positioned on said rest member.

14. The method of supporting a body part for transfer, comprising the steps of:

(a) positioning said body part on a rigid member at rest;

(b) expanding said member by a bellows to an inclined elevation with said body part supported thereon; and (c) transferring said body part from said member.

15. The method of claim 14 further including the step of expanding against said rigid member in association with a bed.

16. The method of claim 14 wherein the positioning step includes positioning a foot upon said member.

17. The method of claim 14 wherein the positioning step includes positioning an arm on said member.

18. The method of claim 14 further including the step of expanding against said member by a compressor.

19. The method of fabricating apparatus for supporting a body part comprising the steps of:

(a) providing a platform supportable by a tubular member pivotally attached thereto configured to said body part; and (b) associating an expandable member with said platform.

20. A method for assisting persons seated on an elevated surface comprising the steps of:

(a) positioning a seated person's lower limb on bellows means for elevating said lower limb;

(b) elevating said lower limb with said person remaining seated; and (c) transferring said elevated lower limb to said elevated surface.

21. A method as defined in claim 20 wherein said means for elevating said lower limb adjoins said elevated surface.

22. A method as defined in claim 20 wherein said person is wheeled to said means for elevating said lower limb and the foot of said lower limb is positioned thereon.

23. A method as defined in claim 20 wherein said lower limb is elevated to substantially the level of said elevated surface.

24. A method as defined in claim 23 wherein said lower limb is transferred to said elevated surface such that said person can adopt a reclined position.

25. The method of fabricating apparatus for supporting a body part comprising the steps of:

(a) providing a pivotal platform configured to said body part; and i. associating an expandable member with said platform;

further including the step attaching a bellows to said platform to serve as said on expandable member.

26. The method of claim 25 further including the step of providing means for angularly inflating said bellows.

27. The method of claim 26 further including the step of providing a valve for inflating said bellows.

28. The method of claim 27 further including the step of providing means for attaching a compressor to said valve.

* * * * *